United States Patent [19]

Berkeley

[11] 4,453,983

[45] Jun. 12, 1984

[54] DIPHASE DRAIN CLEANER

[75] Inventor: Bernard Berkeley, Evanston, Ill.

[73] Assignee: Hysan Corporation, Chicago, Ill.

[21] Appl. No.: 374,450

[22] Filed: May 3, 1982

[51] Int. Cl.[3] ..... B08B 3/08; B08B 9/02

[52] U.S. Cl. ..... 134/22.14; 134/40; 252/143

[58] Field of Search ..... 134/22.14, 40; 252/143

[56] References Cited

U.S. PATENT DOCUMENTS

| | | | |
|---|---|---|---|
| 663,479 | 12/1900 | Waitt . | |
| 686,842 | 11/1901 | Byrnes . | |
| 856,644 | 6/1897 | Laverty . | |
| 2,063,972 | 12/1936 | Adams et al. | 252/143 |
| 2,987,425 | 6/1961 | Shaw | 134/28 |
| 3,060,125 | 10/1962 | Sims | 252/153 |
| 3,538,008 | 11/1970 | Ancel et al. | 252/146 |
| 3,553,145 | 1/1971 | Butke et al. | 252/170 |
| 3,553,146 | 1/1971 | Butke et al. | 252/170 |
| 3,576,751 | 4/1971 | Noznick et al. | 252/162 |
| 3,666,670 | 5/1972 | Gilbert et al. | 252/160 |
| 3,794,523 | 2/1974 | Thompson | 134/3 |
| 4,096,871 | 6/1978 | Van Vlahakis | 134/40 |

*Primary Examiner*—Marc L. Caroff

*Attorney, Agent, or Firm*—Cook, Wetzel & Egan, Ltd.

[57] ABSTRACT

A diphase drain cleaning composition and method wherein the composition has two liquid layers. The lower denser layer makes up from 50 to 99 percent of the total composition weight while the upper less-dense layer makes up from 1 to 50 percent of the total composition weight. The lower layer consists of at least 20 percent sulphuric acid solution. The upper layer consists of an aromatic hydrocarbon solvent such as dichlorobenzene or monochlorotoluene. The composition attacks drain blockage consisting of polystyrene and other organic and inorganic matter in two phases. First, the lower layer of sulphuric acid contacts the blockage and melts and dissolves many organic and inorganic materials. Second, loosened polystyrene, which is not affected by the sulphuric acid, floats to the upper layer where it is dissolved by the solvent making up the upper layer.

13 Claims, No Drawings

DIPHASE DRAIN CLEANER

BACKGROUND OF THE DISCLOSURE

Sulphuric acid has been used to clear drains of many organic materials, including fats, hair, paper, cotton, tea, coffee grounds and tobacco, as well as some inorganic materials such as chalk, hard water salts, lime scale and iron salts. The properties of sulphuric acid which make it effective for drain cleaning include: (1) its high heat of dilution in contact with residual water in the drain which melts fats, greases and low melting compounds that otherwise act as clogging sites for other debris; (2) its reactivity with a wide range of function groups such as hydroxyl, carbonyls, esters, unsaturated bonds, rings and amino groups; and (3) its high dissociation constant that helps dissolve many organic and inorganic materials. Notable examples of use of sulphuric acid to clean drains are U.S. Pat. Nos. 3,538,008 to Ancel et al. and 4,096,871 to Vlahakis.

Polystyrene foam cups, foamed packing materials, wrapping sheets, toys or other items could contribute to drain blockage. Unfortunately, sulphuric acid will not affect polystyrene. Consequently, it is desirable to combine sulphuric acid with a polystyrene solvent in a single drain cleaning system. However, many polystyrene solvents are reactive with sulphuric acid and have not previously been employed together in a stable two-phase drain cleaning composition.

Previous drain cleaning compositions and processes that utilize hydrocarbon solvents include U.S. Pat. Nos. 3,553,145 and 3,553,146 to Butke et al., U.S. Pat. No. 3,666,670 to Gilbert et al., U.S. Pat. No. 3,576,751 to Noznick et al., and U.S. Pat. No. 3,060,125 to Sims. None of the disclosed compositions use halogenated hydrocarbon solvents specifically for dissolution of polystyrene.

It is an object of the present invention to form a two layer composition for diphase cleaning of a drain.

It is another object of the present invention to provide a method of cleaning a drain using a diphase composition of sulphuric acid and selected aromatic hydrocarbons.

DESCRIPTION OF THE INVENTION

I have unexpectedly discovered that certain organic solvents and solvent blends will not be attacked by sulphuric acid. These solvents form a layer above sulphuric acid and dissolve polystyrene while not being affected by, or having an effect upon sulphuric acid. A diphase composition is formed. Further, the two layers produce a synergistic effect. The heat produced by the sulphuric acid reacting with water present in the drain drastically increases the polystyrene dissolving powers of the solvent layers. The solvent layer also acts to wash down the sides of the drain as the drain blockage is removed.

The composition of the invention consists of two mutually immiscible liquid layers. The lower and denser layer makes up from 50 to 99 percent of the total composition weight and consists of at least 20 percent sulphuric acid solution. The preferred composition uses 93 percent sulphuric acid solution for the lower layer.

The sulphuric acid solution should be of sufficient concentration and volume to make a sulphuric acid solution of at least 10% concentration after dilution with water in the drain. Normally, about four ounces of water will sit above a clogged drain. Therefore, a minimum amount of four ounces of at least 25% sulphuric acid solution is required. Of course, less volume of a more concentrated solution would be necessary.

The upper less-dense layer makes up from 1 to 50 percent of the total composition weight and consists of a low molecular weight cyclic aromatic hydrocarbon such as benzene, toluene, zylene or trimethylbenzene (psuedo-cumene). Alternatively, the upper less-dense layer would consist of a halogenated aromatic hydrocarbon such as monochlorotoluene, monobromotoluene, dichlorobenzene, trichloroethylene and trichlorobenzene. The invention contemplates the upper layer composed of any of these substances or a combination of two or more of the substances.

The upper less-dense layer may include saturated aliphatic hydrocarbons to reduce the necessary amount of low molecular cyclic aromatic hydrocarbon or halogenated aromatic hydrocarbons in that layer. Substances such as mineral oil and mineral spirits contain saturated cyclic hydrocarbons adequate for this purpose. The upper layer can be up to 99% by weight saturated cyclic hydrocarbons, being up to almost 5% of the total composition weight. At least 1% by weight of the upper layer should be the halogenated aromatic hydrocarbons or the low molecular weight cyclic aromatic hydrocarbons listed above or any combination thereof. That is, the active ingredients in the upper layer are the aromatic hydrocarbons which should make up at least 0.01% of the total composition weight.

A preferred composition consists of a lower layer being 95% of total composition weight and consisting of 93% sulphuric acid solution. A solvent blend makes up the upper layer, being 5% of the total composition weight. The solvent blend is composed of equal amounts by weight of orthochlorotoluene and saturated cyclic hydrocarbons. Alternatively, the solvent blend may vary from 99% by weight saturated cyclic hydrocarbons, 1% by weight orthochlorotoluene to 100% orthochlorotoluene. The same proportions may be used substituting other aromatic hydrocarbons such as benzene, toluene, zylene, 1,3,5-trimethylbenzene, parachlorotoluene, monobromotoluene, dichlorobenzene, trichloroethylene, and trichlorobenzene for the orthochlorotoluene.

The unhalogenated aromatic hydrocarbons are less stable than the halogenated aromatic hydrocarbons in the presence of sulphuric acid. This is particularly true for storage temperatures above 100° F. Under such conditions, the halogenated aromatic hydrocarbons are preferred over the unhalogenated aromatics.

A corrosion inhibitor, dye or stable fragrance may be added to make the composition more commercially desirable.

Drains are cleaned by the diphase composition in a unique manner. The denser sulphuric acid layer comes in contact with water and the drain blockage. It melts and dissolves fats, hair, paper, cotton, tea, coffee grounds and tobacco, chalk, hard water salts, lime scale, iron salts, and other organic and inorganic substances which may cause drain blockage. Polystyrene material in the drain blockage is not affected by the sulphuric acid but will be released from the drain blockage as the other substances are melted and dissolved. The free polystyrene will float to the upper less-dense layer of aromatic hydrocarbons where it is dissolved. Although the density of the sulphuric acid solution will vary with its strength, it will normally be denser than the aromatic hydrocarbon layer and will, consequently, always be the lower layer in the composition. This guarantees initial contact of the sulphuric acid with the drain blockage.

The following examples demonstrate possible diphase drain cleaning compositions.

Example I

95% by weight 93% sulphuric acid is combined with 5% by weight monochlorotoluene to produce a two layer composition.

Example II

60% by weight 40% sulphuric acid is combined with 20% by weight of trimethylbenzene and 20% by weight of saturated aliphatic hydrocarbons to form a two layer composition for cleaning drains.

Example III

50% by weight 80% sulphuric acid is combined with 19.99% by weight saturated aliphatic hydrocarbons and 0.01% by weight zylene to produce a diphase drain cleaning composition.

While the invention presently disclosed is considered to be the preferred embodiment of the invention, it is understood that changes, modifications and substitutions may be made therein without departing from the true scope of the invention as defined in the claims.

What is claimed is:

1. A stable diphase drain cleaning composition comprising a more dense layer and a less dense layer in contact, the more dense layer consisting essentially of from 50 to 99% by weight of the total composition of at least 20% sulfuric acid solution, and the less dense layer consisting essentially of from 1 to 50% by weight of the total composition of a polystyrene solvent selected from the group consisting of monochlorotoluene, dichlorobenzene, and mixtures thereof.

2. A stable diphase drain cleaning composition comprising a more dense layer and a less dense layer in contact, the more dense layer consisting essentially of from 50 to 99% by weight of the total composition of at least 20% sulphuric acid solution, and the less dense layer consisting essentially of from 0.01 to 50% by weight of the total composition of a polystyrene solvent selected from the group consisting of monochlorotoluene, dichlorobenzene, and mixtures thereof, and up to 49.99% by weight of the total composition of a fully saturated aliphatic hydrocarbon.

3. The drain cleaning composition of claim 2 wherein the sulphuric acid solution is about 93% sulphuric acid solution.

4. The drain cleaning composition of claim 3 wherein the sulphuric acid solution makes up about 95% by weight of the composition.

5. The drain cleaning composition of claim 4 wherein approximately 2.5% by weight of the composition consists of polystyrene solvent and approximately 2.5% by weight of the composition consists of fully saturated aliphatic hydrocarbons.

6. The drain cleaning composition of claim 5 wherein the polystyrene solvent is monochlorotoluene.

7. The drain cleaning composition of claim 1 wherein the sulphuric acid solution is about 93% sulphuric acid solution.

8. The drain cleaning composition of claim 1 or 7 wherein the sulphuric acid solution makes up about 95% by weight of the composition.

9. A diphase drain cleaning process for cleaning drains comprising contacting drain plumbing with a composition consisting essentially of from 50 to 99% by weight of at least 20% sulphuric acid solution and from 1 to 50% by weight of a polystyrene solvent selected from the group consisting of monochlorotoluene, dichlorobenzene, and mixtures thereof, wherein the sulphuric acid solution and the polystyrene solvent form two layers of liquid inside the drain plumbing.

10. A diphase drain cleaning process for cleaning drains comprising contacting drain plumbing with a composition consisting essentially of from 50 to 99% by weight of at least 20% sulphuric acid solution and from 0.01 to 50% by weight of a polystyrene solvent selected from the group consisting of monochlorotoluene, dichlorobenzene, and mixtures thereof, and up to 49.99% fully saturated aliphatic hydrocarbons, wherein the sulphuric acid solution forms one layer and the aliphatic hydrocarbons and polystyrene solvents combine to form a second layer.

11. The diphase drain cleaning process of claim 9 wherein the sulphuric acid layer is denser than the polystyrene solvent layer.

12. The diphase drain cleaning process of claim 11 wherein the sulphuric acid solution dissolves organic material in drain blockage and the polystyrene solvent layer dissolves polystyrene.

13. The diphase drain cleaning process of claim 11 wherein the sulphuric acid solution dissolves organic and inorganic material in drain blockage containing polystyrene thereby releasing polystyrene to float to the polystyrene solvent layer where it is dissolved.

* * * * *